US008511102B2

(12) United States Patent
Feng et al.

(10) Patent No.: US 8,511,102 B2
(45) Date of Patent: Aug. 20, 2013

(54) METHOD FOR DEFROST CONTROL OF A REFRIGERATOR AND REFRIGERATOR WHICH USES THIS METHOD

(75) Inventors: Junhong Feng, Chuzhou (CN); Xiaotian Zhou, Ottobrunn (DE); Qiwu Zhu, Chuzhou (CN); Weizhong Zhu, Chuzhou (CN)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 321 days.

(21) Appl. No.: 12/989,423

(22) PCT Filed: Apr. 17, 2009

(86) PCT No.: PCT/EP2009/054612

§ 371 (c)(1),
(2), (4) Date: Oct. 25, 2010

(87) PCT Pub. No.: WO2009/132971

PCT Pub. Date: Nov. 5, 2009

(65) Prior Publication Data

US 2011/0036105 A1 Feb. 17, 2011

(30) Foreign Application Priority Data

Apr. 29, 2008 (CN) ..... 2008 1 0025191

(51) Int. Cl.
*F25D 21/06* (2006.01)
*F25D 21/00* (2006.01)
*F25D 17/00* (2006.01)

(52) U.S. Cl.
USPC ..... 62/151; 62/80; 62/155; 62/156; 62/234; 62/180

(58) Field of Classification Search
USPC ..... 62/80, 151, 155, 156, 234, 180, 186
See application file for complete search history.

(56) References Cited

U.S. PATENT DOCUMENTS

| | | | | |
|---|---|---|---|---|
| 5,355,686 | A * | 10/1994 | Weiss | 62/89 |
| 5,842,355 | A * | 12/1998 | Kalis et al. | 62/234 |
| 6,330,803 | B1 * | 12/2001 | Shin | 62/156 |
| 6,550,261 | B1 | 4/2003 | Shima et al. | |
| 6,694,755 | B2 | 2/2004 | Collins | |
| 2005/0086955 | A1 * | 4/2005 | Rafalovich et al. | 62/156 |
| 2005/0115252 | A1 * | 6/2005 | Karlsson et al. | 62/141 |
| 2007/0283706 | A1 | 12/2007 | Kang et al. | |

FOREIGN PATENT DOCUMENTS

| | | | |
|---|---|---|---|
| JP | 07-110184 | | 4/1995 |
| JP | 07-120130 | | 5/1995 |
| JP | 09-138045 | | 5/1997 |
| JP | 2005127673 | A * | 5/2005 |
| JP | 2005127673 | A1 | 5/2005 |
| JP | 2007303773 | A | 11/2007 |

* cited by examiner

*Primary Examiner* — Frantz F. Jules
*Assistant Examiner* — Joseph Trpisovsky
(74) *Attorney, Agent, or Firm* — James E. Howard; Andre Pallapies

(57) ABSTRACT

A method for defrost control of a refrigerator having a refrigeration and defrost system that includes a compressor, an evaporator, an evaporator fan and a heater. The refrigerator also has a control system to control the operation of the refrigerator. The method includes stopping the compressor operation; starting a defrost process; starting the heater; maintaining a start state over a preset period of time; closing off the heater; and starting the compressor. After starting the compressor and before the evaporator fan is started to perform the refrigeration operation, the evaporator fan is operated at least once briefly and intermittently.

12 Claims, 2 Drawing Sheets

METHOD FOR DEFROST CONTROL OF A REFRIGERATOR AND REFRIGERATOR WHICH USES THIS METHOD

BACKGROUND OF THE INVENTION

The present invention relates to an electric household appliance and the control method for it, in particular a method for defrost control of an electric household refrigerator and refrigerators which use this method.

When an electric household refrigerator is in use, a coating of frost inevitably forms on the evaporator of the chilled storage compartment and the freezer compartment. It is therefore necessary to start the heating unit installed on the evaporator at regular intervals (this is generally a heating filament in proximity to the evaporator fins), to defrost the evaporator and to convey the melt water away by way of a drainage pipe. The refrigeration control of the refrigerator correspondingly also comprises a chill cycle to chill the storage compartment and a defrost cycle to defrost the evaporator.

A defrost method for electric household refrigerators is disclosed in the U.S. Pat. No. 6,694,755 B2. In the defrost cycle the evaporator is defrosted by starting the heating unit for a preset time period. Once the heating unit has been turned off, before the compressor is started to perform the normal refrigeration cycle, the refrigeration system is stopped for a preset time period, so that the defrost water that has melted on the evaporator can disappear completely from the evaporator and be conveyed away. This preset time period is referred to as drip time.

However this defrost method also has shortcomings. For example the evaporator fan is generally positioned in proximity to the evaporator. The high level of moisture around the evaporator means that during the course of the defrosting of the evaporator a thin layer of water droplets generally forms on the fan blades of the evaporator fan and on the inner surface of the evaporator chamber in proximity to the fan blades due to condensation. Once the heating operation of the heating unit stops, regardless of whether there is drip time or the compressor is started immediately to perform the refrigeration cycle, the temperature of the evaporator chamber drops rapidly. As a result the water droplets on the fan blades of the evaporator fan and on the inner surface of the evaporator chamber in proximity to the fan blades condense very quickly and form a coating of frost. This blocks the space for rotation of the fan blades between the fan blades of the evaporator fan and the inner surface of the evaporator chamber, preventing the evaporator fan starting normally.

BRIEF SUMMARY OF THE INVENTION

The object of the present invention is therefore to provide a method for defrost control of a refrigerator, which can ensure that the refrigeration cycle starts normally after the defrost cycle, and refrigerators which use this method.

To achieve the stated object, a refrigerator of an inventive embodiment comprises a cabinet with storage compartment, a refrigeration and defrost system and a control apparatus to control this refrigeration and defrost system. The refrigeration and defrost system here comprises the elements of compressor, evaporator, evaporator fan and heating unit. The control apparatus comprises an evaporator sensor to check the evaporator temperature and a storage compartment sensor to check the temperature of the storage compartment. After completion of a defrost cycle, before the evaporator fan is started to perform the refrigeration operation, the control apparatus first sets the evaporator fan in operation briefly and intermittently for a preset period of time.

In a further improvement of the present invention the length of the preset time period for brief and intermittent operation is 5 to 30 seconds.

In a further improvement of the present invention the described evaporator is the evaporator of the freezer compartment, the described evaporator fan is the evaporator fan of the freezer compartment and the described conditions for performing the refrigeration operation by starting the evaporator fan are as follows: The evaporator temperature determined by the evaporator sensor is lower than the storage compartment temperature determined by the storage compartment sensor. The described evaporator fan is disposed horizontally on the described evaporator.

A method for defrost control, corresponding to a refrigerator of an inventive embodiment, comprises the following steps:

a) stopping compressor operation, starting the defrost process;

b) starting the heating unit and maintaining the start state over a preset period of time;

c) turning off the heating unit;

d) starting the compressor;

e) after starting the compressor, before the evaporator fan is started to perform the refrigeration operation, the evaporator fan is operated at least once briefly and intermittently.

In a further improvement of the present invention the described step of starting the defrost process comprises the following substeps:

a) stopping compressor operation;

b) starting the evaporator fan and maintaining operation over a preset time period;

c) stopping operation of the evaporator fan and maintaining the stopped state over a preset time period;

d) starting the heating unit.

In a further improvement of the present invention the described step of starting the compressor comprises the following substeps:

a) turning off the heating unit;

b) stopping the refrigeration system for a preset time period;

c) starting the compressor at the end of the preset stoppage period.

In a further improvement of the present invention the described step, in which the evaporator fan is operated at least once briefly and intermittently comprises the following substeps:

a) after the compressor starts, the evaporator fan remains stopped for a preset time period;

b) starting the evaporator fan and operating it briefly for a preset time period;

c) stopping the evaporator fan and maintaining the stopped state for a preset time period;

d) judging whether it is necessary to start the evaporator fan briefly once again.

The beneficial effect of the present invention is that after the defrost cycle and before the compressor and evaporator fan are started to perform the normal refrigeration cycle, the evaporator fan is operated once or a number of times briefly beforehand, so that the water droplets on the fan blades can be spun off, thereby preventing frost formation on the fan blades in the following refrigeration cycle.

DETAILED DESCRIPTION OF EXEMPLARY EMBODIMENTS OF THE PRESENT INVENTION

Figure 1:
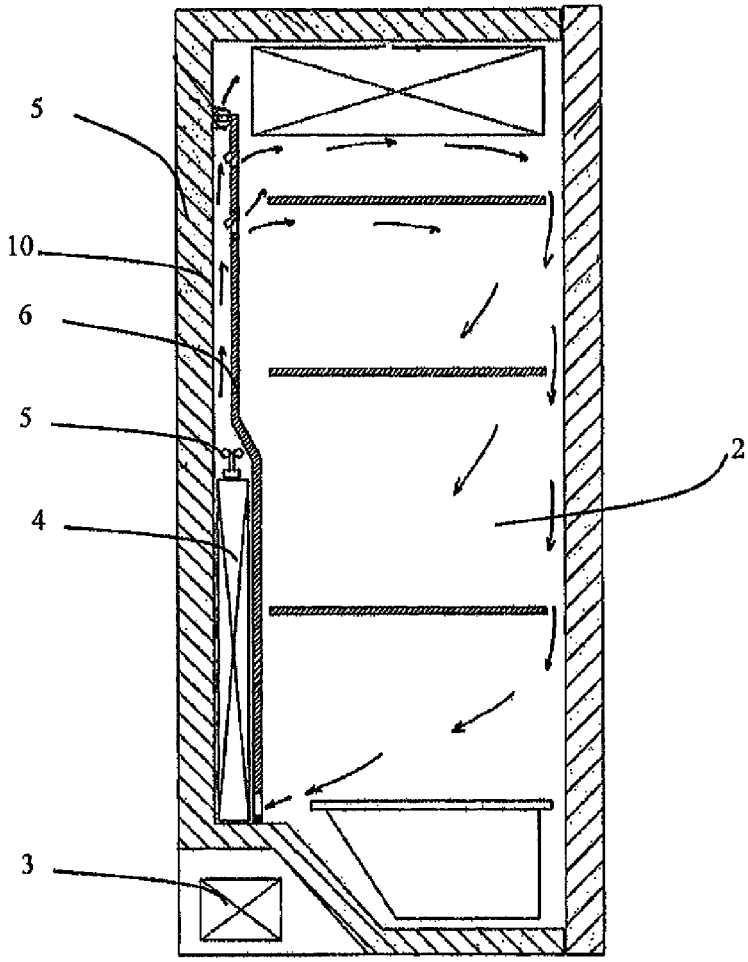
FIG. 1 shows a schematic diagram of the refrigeration and defrost system of a refrigerator of an inventive embodiment.

As shown in FIG. 1 a refrigerator of an inventive embodiment comprises a cabinet 1, with storage compartment 2, a refrigeration and defrost system and a control apparatus for controlling said refrigeration and defrost system. The refrigeration and defrost system here comprises the elements of compressor 3, evaporator 4, evaporator fan 5 and heating unit (not shown) and the control apparatus comprises an evaporator sensor to check the evaporator temperature and a storage compartment sensor (not shown) to check the temperature of the storage compartment. In this embodiment the storage compartment 2 is the freezer compartment of the refrigerator, the setpoint temperature of which is generally minus 18° C. The evaporator 4 is the evaporator of the freezer compartment, which is fitted between the rear wall 10 of the cabinet 1 and the evaporator cover 6. (The space in which the evaporator is housed may be referred to as the evaporator chamber). The evaporator fan 5 is the evaporator of the freezer compartment, which is positioned in proximity to the evaporator of the freezer compartment. The fan blades of the evaporator fan are disposed horizontally, the distance between the rear wall 10 of the cabinet 1 and the evaporator cover 6 also being very short. The heating unit can be a standard electric heating filament, which is connected and fastened together in proximity to the fins of the evaporator and the refrigerant tube. The storage compartment sensor is a temperature sensor to check the temperature of the freezer compartment, which is positioned on the inner wall of the freezer compartment. The evaporator sensor is a temperature sensor to check the temperature of the evaporator, which is positioned on the evaporator. The temperature determined by these two temperature sensors is fed back to the circuit board of the control apparatus and is processed there. The control apparatus sends corresponding control signals to the elements of compressor 3, evaporator 4, evaporator fan 5 and heating unit according to the processing result.

Figure 2:
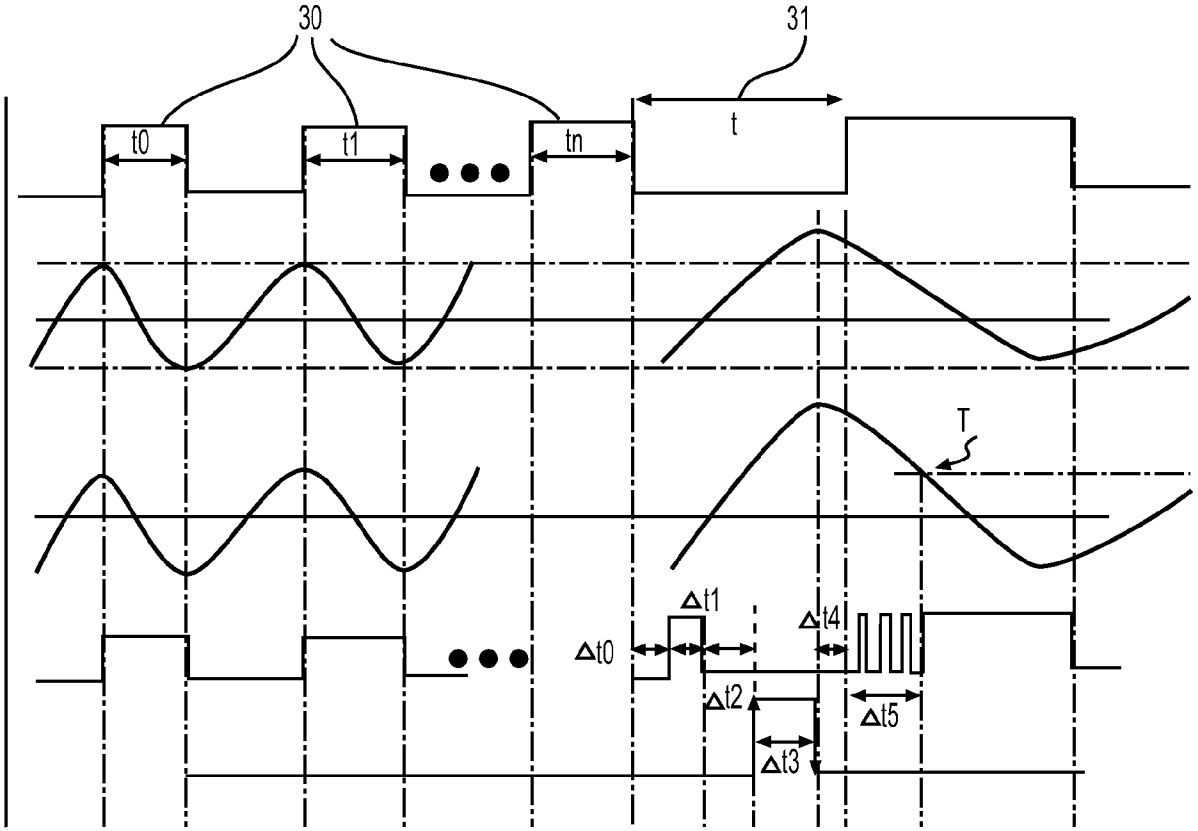
FIG. 2 shows a basic circuit diagram for the control of the refrigeration and defrost system of the present invention.

As shown in FIG. 2 the control process of the refrigeration and defrost system of the present invention comprises the refrigeration cycle 30 and the defrost cycle 31. The refrigeration cycle 30 comprises a number of continuously repeated refrigeration processes t0, t1 . . . tn. Example refrigeration process t1: when in the previous refrigeration process t0 the temperature of the freezer compartment reaches the stop temperature of the compressor, the compressor and evaporator fan cease operation, the temperature of the freezer compartment then rises continuously and the rise reaches the setpoint temperature point, the compressor is turned on. At the same time the evaporator fan is set in motion and the refrigeration process t1 starts. When the temperature of the freezer compartment again reaches the stop temperature of the compressor, the compressor and evaporator fan once again cease operation, the temperature of the freezer compartment then rises continuously again and the rise again reaches the setpoint temperature point, the compressor is turned on again and the next refrigeration process t2 starts.

During the constantly repeated refrigeration process the control system judges continuously, based on preset conditions, whether the system already satisfies requirements for the start of the defrost cycle 31. In the present invention the preset conditions for starting the defrost cycle 31 comprise the length in time of the previous defrost cycle, the length of the operating time of the refrigeration cycle 30, the length of the on-off period when the compressor is turned on, the number of times the door is opened, etc. When the control system judges that the ongoing defrost cycle 31 must be started, the compressor is stopped and the defrost process t starts.

In this embodiment the defrost process t comprises the 5 phase-type time segments Δt0, Δt1, Δt2, Δt3 and Δt4, which are described below. Once the defrost process t has started, the first time segment is the segment Δt0. Δt0 is a preset time segment. In Δt0 the compressor is in the stopped state, the evaporator fan is in the stopped state, the heating unit is in the turned off state. The object of establishing the time segment Δt0 is to give the liquid refrigerant of the evaporator sufficient time to flow back into the accumulator. The second time segment is time segment Δt1. Δt1 is a preset time segment. In Δt1 the compressor is in the stopped state, the evaporator fan is in a state of ongoing operation, the heating unit is in the turned off state. The object of establishing time segment Δt1 is to allow the air flow at a high relative temperature in the freezer compartment to be absorbed into the evaporator chamber and to flow past the surface of the evaporator so that the temperature of the evaporator can be raised to a certain degree beforehand. The third time segment is the segment Δt2. Δt2 is a preset time segment. In Δt2 the compressor is in the stopped state, the evaporator fan is in the stopped state, the heating unit is in the turned off state. The fourth time segment is the segment Δt3. In Δt3 the compressor is in the stopped state, the evaporator fan is in the stopped state, the heating unit is in the continuously turned on state. The object of establishing the time segment Δt3 is to use the heating unit to heat the evaporator to allow the temperature of the evaporator to rise rapidly, thereby achieving effective and rapid defrosting. Δt3 is a preset time segment, the length in time of which is subject to the influence of two factors: 1. set defrost temperature of evaporator: when the evaporator temperature determined by the evaporator sensor has risen to the set defrost temperature value, the heating unit is turned off. 2. maximum defrost time: when the control system determines that Δt3 has already reached the preset maximum time for the heating unit to be turned on, the heating unit is immediately turned off, even if the evaporator temperature has not yet risen to the set defrost temperature value. The fourth time segment is the segment Δt4. In Δt4 the compressor is in the stopped state, the evaporator is in the stopped state, the heating unit is in the turned off state. The object of establishing the time segment Δt4 is to allow the melt water on the evaporator to drip off the evaporator completely.

After the end of time segment Δt4 the compressor is started and turned on. The evaporator temperature then starts to drop. Since the temperature of the evaporator is higher than the temperature of the freezer compartment, at this point the evaporator fan cannot immediately resume normal refrigeration operation. Otherwise the air flow in the evaporator chamber would be carried along into the freezer compartment at a higher temperature than the freezer compartment temperature. However if the evaporator fan is kept constantly in the idle state, the temperature of the evaporator chamber also drops continuously, since the evaporator temperature drops without interruption, with the result that the water droplets on the blades of the evaporator fan and on the inner surface of the evaporator chamber in proximity to the evaporator fan rapidly condense to form frost, thereby blocking the space for rotation of the fan blades between the fan blades of the evaporator fan and the inner surface of the evaporator chamber, as a result then making it impossible for the evaporator fan to start normally. For this reason time segment Δt5 has also been established in the present invention.

The start point of time segment Δt5 is the end point of time segment Δt4. The end point of Δt5 is the node point T of the set temperature, to which the evaporator temperature drops. At this node point T the evaporator temperature can be less than or equal to the temperature of the freezer compartment. The overall length of the time segment Δt5 can be between 5 and 30 seconds. In this time segment Δt5 the evaporator fan is operated at least once briefly and intermittently. The object is to spin off the water droplets on the fan blades, thereby preventing frost formation on the fan blades in the following refrigeration cycle. Each brief operation generally comprises the following steps: a) after the compressor is started, the evaporator fan is kept in the idle state for a preset time period; b) starting the evaporator fan and brief operation for a preset time period; c) stopping the evaporator fan and maintaining the stopped state for a preset time period; d) judging whether it is necessary to start the evaporator fan briefly again. The reference conditions for the number of brief operations (once or a number of times) include the volume of the freezer compartment, the temperature when the evaporator fan starts to perform the refrigeration operation, the size of the dimensions of the blades of the evaporator fan, etc. When the time segment Δt5 has ended, the evaporator fan is started and performs an ongoing normal refrigeration operation. At this point the control apparatus resumes the normal refrigeration cycle 30 and awaits the return of the next defrost cycle 31.

The details above relate to just one embodiment of the present invention. General technical operators within this field are able to adapt the embodiment of the present invention based on the embodiment set out above without inventive activity. For example this embodiment is applied to a freezer compartment evaporator, while in other embodiments the defrost method of the present invention may also be applied to the evaporator of the chilled storage compartment and the evaporator fan of the chilled storage compartment, in particular to a chilled storage compartment that has a variable temperature zone, the temperature of which can be switched between plus and minus degrees. These appropriate adaptations should lie within the scope of protection of the claims of the present invention.

The invention claimed is:

1. A method for defrost control of a refrigerator having a refrigeration and defrost system that includes a compressor, an evaporator, an evaporator fan having fan blades and located in an evaporator chamber, a heater, and a control system to control refrigerator operation, the method comprising:

stopping compressor operation;

starting a defrost process;

starting the heater;

maintaining a start state over a first preset period of time;

closing off the heater; and starting the compressor;

wherein, after starting the compressor and before starting the evaporator fan to perform the refrigeration operation, the evaporator fan is operated at least once briefly and intermittently at a speed such that water droplets on the fan blades and an inner wall of the evaporator chamber are ejected from the fan blades and the evaporator chamber.

2. The method of claim 1, wherein the step of starting the defrost process includes:

stopping the compressor operation;

starting the evaporator fan and maintaining operation over a second preset period of time;

stopping operation of the evaporator fan and maintaining a stopped state of the evaporator fan over a third preset period of time; and starting the heater.

3. The method of claim 1, wherein the step of starting the compressor includes:

closing off the heater;

stopping the refrigeration system for a fourth preset period of time; and starting the compressor at an end of the preset stoppage period.

4. The method of claim 1, wherein the step of operating the evaporator fan at least once briefly and intermittently includes:

after the compressor starts, keeping the evaporator fan stopped for a fifth preset period of time;

starting the evaporator fan and operating the evaporator fan briefly for a sixth preset period of time;

stopping the evaporator fan and maintaining a stopped state of the evaporator fan for a seventh preset period of time; and evaluating whether it is necessary to start the evaporator fan briefly once again.

5. The method of claim 4, wherein the sum of the fifth, sixth, and seventh periods of time period is between 5 seconds and 30 seconds.

6. The method of claim 1, wherein the control system includes an evaporator sensor to check an evaporator temperature and a storage compartment sensor to check a storage compartment temperature, and a condition for the starting of the evaporator fan to perform the refrigeration operation is that the evaporator temperature measured by the evaporator sensor is lower than the storage compartment temperature measured by the storage compartment sensor.

7. The method of claim 6, wherein the evaporator is a freezer compartment evaporator and the evaporator fan is a freezer compartment evaporator fan.

8. A refrigerator, comprising:

a cabinet with a storage compartment;

a refrigeration and defrost system; and a control apparatus to control the refrigeration and defrost system, wherein the refrigeration and defrost system includes a compressor, an evaporator, an evaporator fan having fan blades and being located in an evaporator chamber, and a heater, the control apparatus includes an evaporator sensor to check an evaporator temperature and a storage compartment sensor to check a storage compartment temperature, and after completion of a defrost cycle and before the evaporator fan is started to perform the refrigeration operation, the control apparatus sets the evaporator fan in operation briefly and intermittently for a preset period of time at a speed sufficient to eject from the fan blades and the evaporator chamber water droplets on the fan blades and on inner walls of the evaporator chamber.

9. The refrigerator of claim 8, wherein a length of the preset time period for the brief and intermittent operation is 5 seconds to 30 seconds.

10. The refrigerator of claim 8, wherein the evaporator is a freezer compartment evaporator and the evaporator fan is a freezer compartment evaporator fan.

11. The refrigerator of claim 8, wherein a condition for starting the evaporator fan to perform the refrigeration operation is that the evaporator temperature measured by the evaporator sensor is lower than the storage compartment temperature measured by the storage compartment sensor.

12. The refrigerator of claim 11, wherein the evaporator fan is disposed horizontally above the evaporator.

* * * * *